US008615949B2

(12) United States Patent
Georgievski

(10) Patent No.: US 8,615,949 B2
(45) Date of Patent: Dec. 31, 2013

(54) REPAIR DEVICE

(76) Inventor: Louie Georgievski, Yarraville (AU)

( * ) Notice: Subject to any disclaimer, the term of this patent is extended or adjusted under 35 U.S.C. 154(b) by 0 days.

(21) Appl. No.: 12/928,403

(22) Filed: Dec. 10, 2010

(65) Prior Publication Data

US 2011/0107705 A1 May 12, 2011

Related U.S. Application Data

(63) Continuation of application No. PCT/AU2008/001258, filed on Aug. 26, 2008.

(51) Int. Cl.
*E02D 37/00* (2006.01)

(52) U.S. Cl.
USPC ..... 52/514; 52/98; 411/340

(58) Field of Classification Search
USPC ..... 52/741.41, 514, 98; 411/340; 254/100
See application file for complete search history.

(56) References Cited

U.S. PATENT DOCUMENTS

| | | | | | |
|---|---|---|---|---|---|
| 503,079 | A * | 8/1893 | Gowen | 114/227 |
| 3,325,955 | A * | 6/1967 | Haut | 52/514 |
| 3,373,467 | A * | 3/1968 | Loughrey | 425/12 |
| 3,690,084 | A * | 9/1972 | Leblanc | 52/514 |
| 4,075,809 | A * | 2/1978 | Sirkin | 52/514 |
| 4,193,243 | A * | 3/1980 | Tiner | 52/514 |
| 4,285,183 | A * | 8/1981 | Condit | 52/514 |
| 4,286,497 | A * | 9/1981 | Shamah | 411/342 |
| 4,848,056 | A * | 7/1989 | Kelly | 52/514 |
| 5,018,331 | A * | 5/1991 | Forzano | 52/514 |
| 5,033,949 | A * | 7/1991 | Jewett | 425/12 |
| 5,702,218 | A * | 12/1997 | Onofrio | 411/552 |
| 5,778,624 | A * | 7/1998 | Russell | 52/514 |
| 5,875,606 | A * | 3/1999 | Jensen | 52/741.41 |
| 5,983,587 | A * | 11/1999 | Limonad | 52/514 |
| 6,023,901 | A * | 2/2000 | Jensen | 52/514 |
| 6,044,613 | A * | 4/2000 | Crafts et al. | 52/741.1 |
| 6,317,952 | B1 * | 11/2001 | Vogt | 29/402.09 |
| 6,508,040 | B2 * | 1/2003 | Nelson | 52/514 |
| 6,594,967 | B1 * | 7/2003 | Panahii | 52/514 |
| 7,121,054 | B2 * | 10/2006 | Shock | 52/514.5 |
| 7,226,261 | B1 * | 6/2007 | Bristol | 411/342 |
| 7,730,691 | B2 * | 6/2010 | Patrick | 52/514 |
| 8,024,903 | B2 * | 9/2011 | Riggs | 52/514 |
| 2005/0086889 | A1 * | 4/2005 | Shock | 52/514 |
| 2005/0204672 | A1 * | 9/2005 | Hansen | 52/514 |
| 2006/0101765 | A1 * | 5/2006 | Bailey | 52/514 |

* cited by examiner

*Primary Examiner* — Basil Katcheves
*Assistant Examiner* — Joshua Ihezie
(74) *Attorney, Agent, or Firm* — Holland & Hart LLP

(57) ABSTRACT

A repair device for sealing a hole in a wall and enabling its repair without the need for numerous tools and processes, the device comprising; a body portion having at least two plate members each having a front face and a rear face; at least one hinging means hingedly connecting the at least two plate members to each other; a biasing means engaging the at least two plate members to bias the plates apart into an open flat position such that the relative front faces of each of the at least two plate members substantially share the same plane; and at least one attachment means mounted on a front face of the at least two plate members; wherein the repair device allows for insertion into the hole in a folded position and release to the open flat position and the attachment means provide attachment to the wall adjacent the hole.

14 Claims, 4 Drawing Sheets

REPAIR DEVICE

FIELD OF THE INVENTION

The invention relates to methods and instruments for repairing a hole in a wall and in particular, to a repair device which provides a simple means for sealing a hole and enabling its repair without the need for numerous tools and processes.

Whilst the invention may be adapted for repairing any type of hole provided on walls or surfaces made of any suitable material such as plasterboard, cement or brick or the like, for convenience it shall be described herein in terms of a device used to repair holes in walls constructed from a plasterboard material.

BACKGROUND TO THE INVENTION

Holes in walls and ceilings are an eyesore but repairs to them can often be difficult. One method of repairing a hole in a wall involves placing a wire mesh over the hole, securing it and covering the mesh with a plaster or similar material. However, this method does not provide a repaired surface that is flush to the wall and is restricted to plasterboard walls.

Another solution is to fill the wall with solid material, such as wood, and then remove any gaps to make it sealed. This option would only be suitable on walls what can be painted again to provide an attractive and uniform finish. Also the finished surface may not be flush at the repair point with the surrounding wall.

If the hole is small enough, some expanding foams can be used to fill it. This foam needs to dry before it can be covered over with paint or plaster. Before the covering layer is applied the foam will need time to cure and it then may need to be sanded back to create a flush finish. The nature of the foam is such that it can result in a small dent in the wall which may require further filling after the initial foam has dried. Also the foam may be porous and when covering with paint or plaster may result in some being absorbed by the foam providing a finish that is not appealing to the eye.

A large obstruction, such as a painting, can be used to cover the hole. This is not a repair though, rather it is only hiding the hole from other's view. Once the occupants of the building re-arrange their decor or move out of the building, the hole will be exposed again.

Covering the hole with tiles is a more permanent covering solution, but offers similar problems to using a removable obstruction. If the tiles are removed during a change of decor, the hole will be revealed and will still need repairing if the wall is not to be re-tiled.

Accordingly, it is an object of the present invention to provide a repair device which provides a simple means for sealing a hole and enabling its repair without the need for numerous tools and processes.

SUMMARY OF THE INVENTION

The present invention provides a repair device including a body portion including at least one plate member, preferably two, having a front face and a rear face hingedly connected to each other; at least one hinging means; a biasing means such that when the repair device is moved into a folded position the biasing means will bias the plates apart into a flat position such that the front surfaces substantially share the same plane; and at least one attachment means whereby the repair device provides a simple means for sealing a hole and enabling its repair without the need for numerous tools and processes. The invention also provides a repair device for sealing a hole in a wall or the like and enabling its repair without the need for numerous tools and processes, the device including a body portion having at least two plate members each having a front face and a rear face, at least one hinging means hingedly connecting the at least two plate members to each other, a biasing means engaging the at least two plate members to bias the plates apart into an open flat position such that the relative front faces of each of the at least two plate members substantially share the same plane; and at least one attachment means mounted on a front face of the at least two plate members; whereby the repair device allows for insertion into the hole in a folded position and release to—J—the open flat position and the attachment means provide attachment to the wall adjacent the hole.

The repair device can include a holding means able to be continually attached to the repair device when in a folded position against the bias of the biasing means and also when in an open flat position of the plates, and the holding means extending outwardly from the plane of the at least two plate members when in the open flat position. The two adjacent plate members can have interfitting edge portions extending across the hinged join of the adjacent two plate members whereby the interfitting edge portions are coplanar with the rest of plates in the open flat position of the plates.

A locking means can be provided which is able to extend across the hinged join of the front faces of adjacent two plate members. The locking means can be in the form of a rigid annular ring which is able to be held by the holding means in the form of a threaded screw through the centre of the rigid annular ring and into the aperture located substantially near a hinging line in the centre of the device wherein the aperture is adapted to receive the holding means wherein the locking means is retained in front of the front faces of the plate members when biased to the substantially open flat position. The locking means also acts to provide flush finish to receive the holding means in an after use position.

Also in accordance with the invention there is provided a method of repair of a hole in a cavity wall or the like including the steps of:

a. providing a repair device having two plates sized greater than a hole in a cavity wall or the like, the two plates hinged together and engaged by a biasing means tending the two plates to a substantially coplanar alignment of the two plates, the two plates having an attachment means on a front surface thereof;
b. inserting the repair device into the hole in a cavity wall or the like in a folded state against the bias of the biasing means;
c. allowing the biasing means to tend the two plates to a substantially coplanar alignment of the two plates with at least part behind the wall adjacent the hole;
d. attaching the repair device to the rear of the wall adjacent the hole by the attachment means; and
e. filling the hole in front of the repair device.

The method can further include the steps of:

f. Providing a holding means able to continually attach to the repair device when in a folded position against the bias of the biasing means and when in an open position of the plates and to extend from the plates through the hole in the cavity;
g. Holding the holding means to align the repair device and to positively urge the attachment means on the front faces of the two plates to attach to the rear of the wall adjacent the hole.

Still further the method can include the steps of:

h. Providing a locking means able to extend across the hinged join of the front faces of the two plates;

i. Locking the hinged join of the front faces of the two plates by securing the locking means to the two plates and locking the front faces to a substantially planar arrangement even when the holding means positively urges the attachment means on the front faces of the two plates to attach to the rear of the wall adjacent the hole.

j. Moving the holding means to a completed position out of the way of filling the hole in front of the repair device.

The step of moving the holding means to a completed position out of the way of filling the hole in front of the repair device includes inserting the holding means into the locking means so as to not extend out of the hole beyond the front surface of the wall.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF THE DRAWINGS

In order that the invention may be more readily understood we will describe by way of non-limiting example a specific embodiment thereof with reference to the drawings wherein.

DESCRIPTION OF A PREFERRED EMBODIMENT OF THE INVENTION

Figure 1:
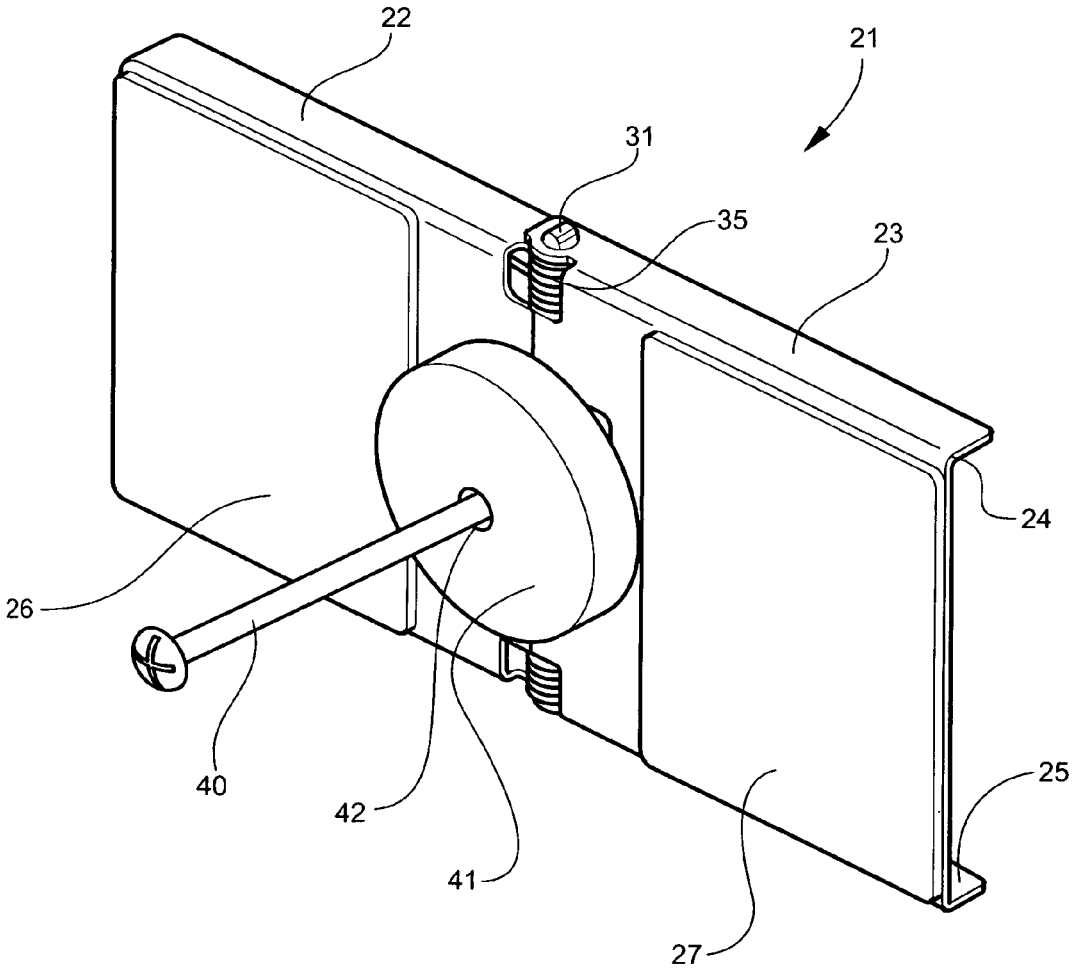
FIG. 1 is a perspective front view of a repair device in accordance with the invention.
Figure 2:
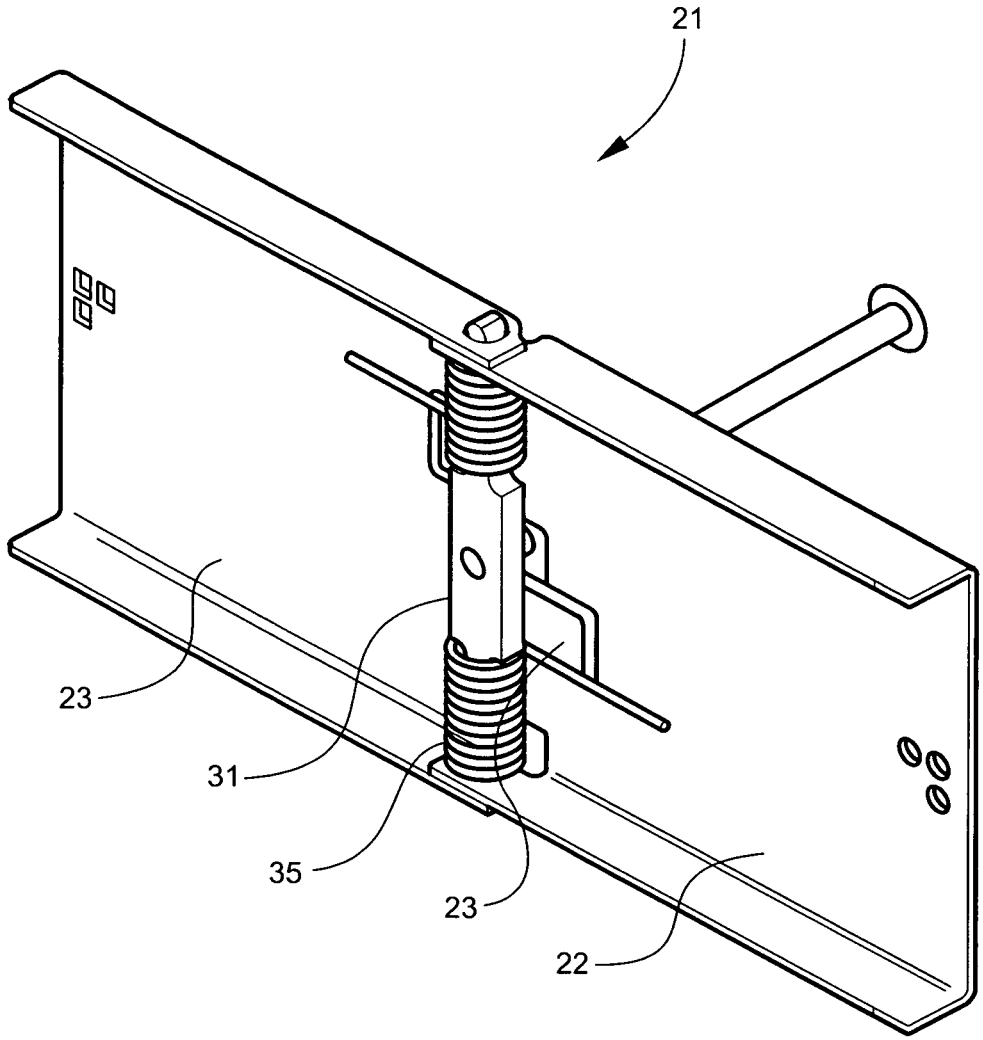
FIG. 2 is a perspective rear view of the repair device of FIG. 1.

Referring to the drawings and particularly FIGS. 1 and 2, there is shown a repair device which for sealing a hole and enabling its repair without the need for numerous tools and processes. The invention shall be described herein in terms of being used to repair holes in walls which are constructed from a plasterboard or dry wall material. However, it is envisaged that the device may be modified to be applicable for repairing holes in walls constructed from any other suitable material such as cement or brick or the like.

The repair device 21 has provided a body portion with two plate members 22, 23. The body portion can be formed of a plastic, metal or any other suitable material. The plate members 22, 23 are in this form rectangular in shape and have provided a front face and a rear face with a flat surface so that the body portion can be located flush against the wall surface.

The plate members 22, 23 have provided two flange portions 24, 25, which extend along the length of the top and bottom edges of the plate members. The flange portions are integrally formed with the top and bottom edges of the plate member and extend outwardly at a right angle to the surface of the plate member. A first plate member 22 is preferably adapted to be slightly smaller in width than a second plate member 23 so that the first plate member can be partially positioned within the second plate member.

The two plate members are adapted to be connected together along an adjoining side wall when positioned adjacent each other. The flange portions 24, 25 have provided near adjacent ends an aperture which is adapted to receive a pin 31 of a hinging means to allow the plate portions to be hingedly connected to each other when the plates and apertures are in proper alignment which enables the plate members to be moveable about an axis coextending with the adjacent ends of plates. However, as shown particularly in FIGS. 2 and 3 the two adjacent plate members 22, 23 have interfitting edge portions extending across the hinged join of the adjacent two plate members whereby the interfitting edge portions are coplanar with the rest of plates in the open flat position of the plates.

The repair device 21 further includes a biasing means 35 for tending the plates to a substantially flat arrangement. Each end of the pin 31 is adapted to be received through the apertures provided in the flange portion of the plate members when the plate members are properly aligned.

A holding means in the form of a screw 40 with extended head is able to be continually attached to the repair device when in a folded position against the bias of the biasing means and also when in an open flat position of the plates with the screw 40 extending outwardly from the plane of the at least two plate members when in the open flat position. Provided in the middle of the pivot pin 31 is an aperture which is adapted to receive the threaded screw 40 therethrough.

The biasing means is in the form of a coil spring 35 that is located on or near the hinge axis along the rear face of the plate members 22, 23 and engages at least partially across both plates. When the plates are in the flat position one edge of each plate will interfit, forming a non-connected boundary line that extends on both sides of the hinge axis. This facilitates the planar alignment of the plate members in the open flat position.

Figure 3:
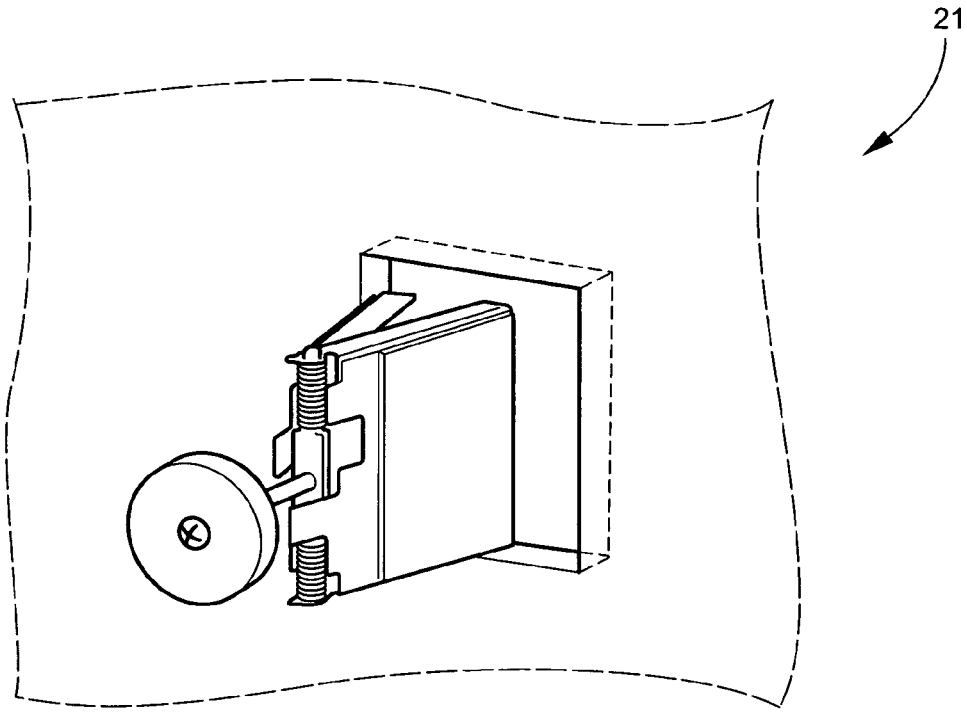
FIG. 3 is a diagrammatic view of the repair device of FIG. 1 in a partially folded form against the bias of the biasing means.
Figure 4:
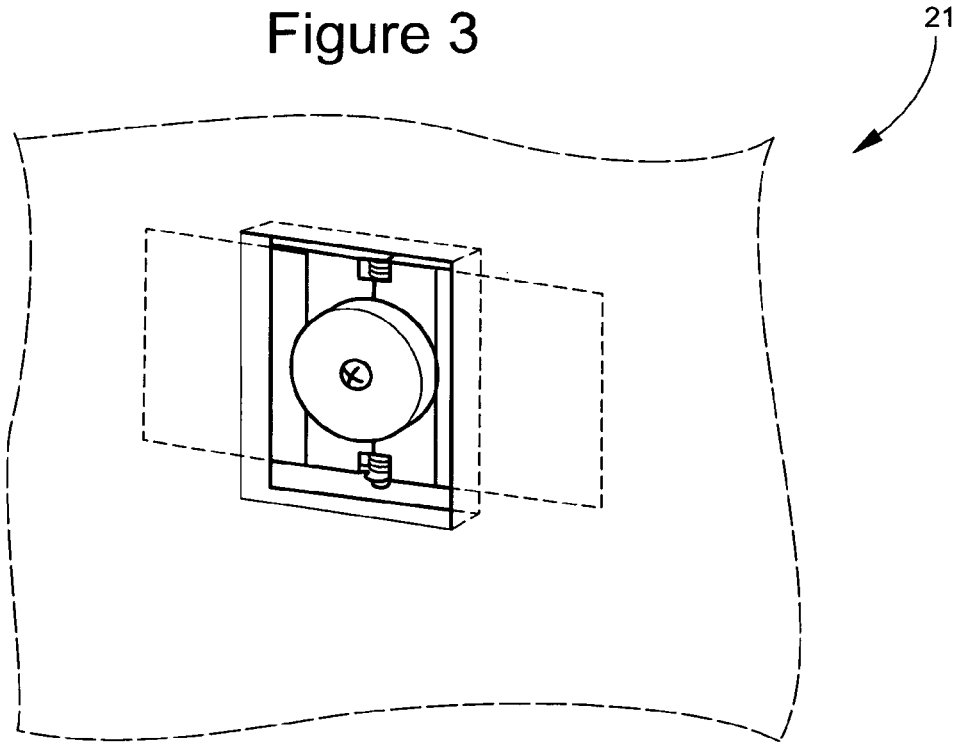
FIG. 4 is a diagrammatic view of the repair device of FIG. 1 in an expanded open form due to the bias of the biasing means.

As shown in FIGS. 3 and 4 if repair device is moved into a folded position the spring will bias the plates apart into a flat position upon release such that the front surfaces of the plate members are substantially flat and share the same plane. It is envisaged that any other suitable hinge mechanism or connection means providing movement may also be used.

The repair device 21 includes attachment means 26, 27 for attachment of the repair device to the surrounding wall to secure the device in place. The attachment means 26, 27 are located on the front surface of each plate member 22, 23 at the outer side of the plate members. The attachment means can be in the form of a double-sided adhesive pad.

The plates are held in the substantially flat position by a locking means in the form of an annular ring 41 which may be a plastic disc or the like. The ring 41 is placed over the edges of both plates 22, 23, and it is held in place with an adhesive layer on its bottom surface. The ring is affixed to the plates after the device is inserted into the wall and positioned on the front surface of the body portion such that the inner wall of the ring aligns with the perimeter of the central aperture on the body portion to enable the fastening means to be received therethrough. The ring enables the plates to be in the open flat position and is more beneficially achieved by one edge of each plate interfit and forming a non-connected boundary line that extends on both sides of the hinge axis. This facilitates the planar alignment of the plate members in the open flat position. Another benefit of the ring 41 is that the screw 40 can be screwed into the device to provide a flush surface with the wall for re-plastering and repair of the hole.

Figure 5:
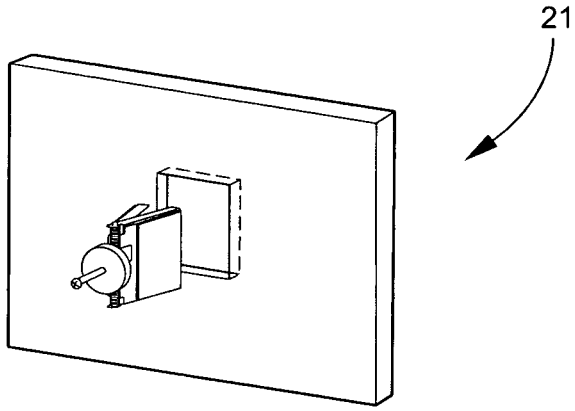
FIGS. 5, 6 and 7 are diagrammatic views of the steps of use of the repair device in accordance with a method of repair according to the invention.
Figure 6:
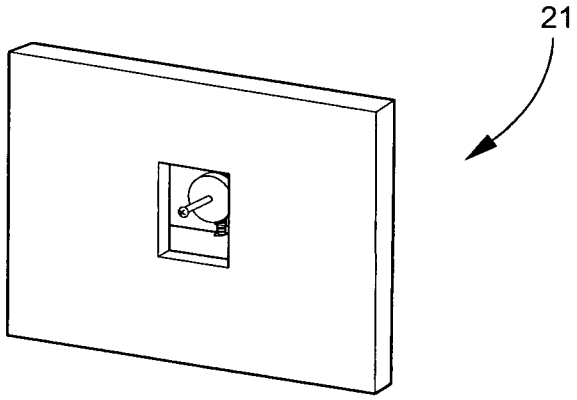
Figure 7:
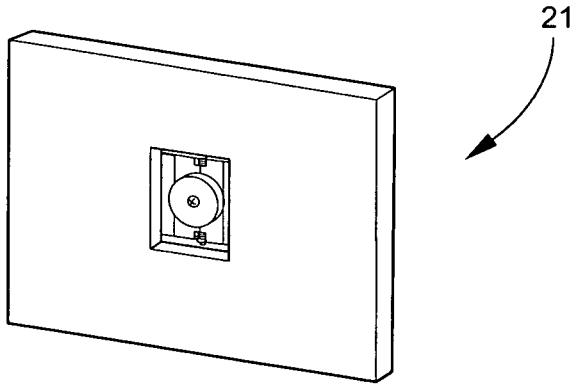

In use as shown in FIGS. 5, 6 and 7, a user screws a bolt into place through the aperture on the plates and the aperture on the hinge pin. The bolt is not screwed in completely, with some of it protruding from the front faces of the plates. If the device is using double-sided adhesive pads as the attachment means, any protective sheets covering the pads will be removed. The plates are then moved into a folded position, as shown in FIG. 5 by rotating the plates about the hinge pin toward the centre of the device and held in place by the user to avoid the spring from returning the plates to the flat position.

The folded device is then inserted into a hole that is to be covered as shown in FIG. 6. If the device does not fit conveniently, the hole will need to be enlarged by cutting or similar means before the insertion of the device takes place. The user then grips the screw head 40 and slowly releases the plates, allowing the spring 35 to return the plates to the open flat position behind the wall adjacent the hole.

While gripping the screw 40, the user then aligns the plates 22, 23 such that the entire hole will be covered by the plates from the other side. When this alignment is achieved the user will use the screw head 40 to pull the plates towards the user resulting in the attachment means 26, 27 engaging the inside surface of the plaster wall. As the attachment means 26, 27 are adhesive pads, the adhesive will hold the device in place. If the attachment means are a series of teeth, the teeth will dig into the plaster board holding the device in place. The locking means can be used to provide a stabilising force on the front surfaces of the plate member 22, 23 near the hinge axis which opposes the tendency for the plate members to fold around the hinge axis due to the outer edges of the plate members receiving force from the wall.

Once the device is secure, the locking means in the form of an annular ring 41 is placed which includes an adhesive on its base can stick to the faces of the plates. The ring will rest across the hinge boundary line with substantially half of the ring located on each side of the line. Once the adhesive is cured, the plates will be held in the flat position and will resist being moved to the folded position. After the ring is secure, the screw 40 can be screwed in completely to sit flush on the faces of the plates which will also provide resistance to the plates being moved into the folded position.

Finally, the hole can be filled with plaster or a similar filling composition. The now secure plates will provide a backing to support the filling composition while it cures. Once cured, the filling composition can be sanded back in preparation for painting or similar to create a flat profile matching the rest of the undamaged wall.

While we have described herein a particular embodiment of a repair device, it is further envisaged that other embodiments of the invention could exhibit any number and combination of any one of the features previously described. However, it is envisaged that any other suitable shape and dimensions of plate members can be employed to suit the hole being repaired. Also in an alternate embodiment the attachment means can be a series of teeth or other suitable attachment better suited at providing a strong hold to the wall depending on the material it is constructed from. However, it is to be understood that any variations and modifications can be made without departing from the spirit and scope thereof of the following claims.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

The invention claimed is:

1. A repair device for sealing a hole in a wall and enabling repair, the device comprising;

a. a body portion having at least two plate members, each of the at least two plate members having a front face, the front face having at least one attachment means mounted on the front face, the attachment means comprising an adhesive;

b. at least one hinging means hingedly connecting the at least two plate members to each other such that the at least two plate members are moveable from a folded position to an open flat position;

c. a biasing means engaging the at least two plate members to bias the plates apart from the folded position into the open flat position, when the body portion is inserted into the hole, such that the relative front faces of each of the at least two plate members share the same plane in the open flat position and the adhesive attaches the body portion to the wall; and, d. a locking means, the locking means extending across the hinged join of the front faces of adjacent two plate members.

2. The repair device according to claim 1 further comprising a holding means able to be continually attached to the repair device when in a folded position against the bias of the biasing means and also when in an open flat position of the plates, and the holding means extending outwardly from the plane of the at least two plate members when in the open flat position.

3. The repair device according to claim 1 wherein the at least two plate members have interfitting edge portions extending across the hinged join of the two plate members whereby the interfitting edge portions are coplanar with the two plate members in the open flat position of the two plate members.

4. The repair device according to claim 1 wherein the at least two plate members comprises a first plate member which is adapted to be slightly smaller in width than a second plate member so that the first plate member can be partially positioned within the second plate member when in a folded position.

5. The repair device according to claim 4 wherein the plate members further comprise at least one flange portion which extends along the length of the top and bottom edges of the plate members.

6. The repair device according to claim 5 wherein the flange portions further comprise respective aligned apertures which are adapted to receive a pivot pin to form the hinging means and allow the plate members to be hingedly connected to each other.

7. The repair device according to claim 1 wherein the hinging means comprises a pivot pin and the at least one biasing means for biasing the plate members to a substantially flat arrangement.

8. The repair device according to claim 1 wherein the biasing means comprises a coil spring or a leaf spring that is located on or near the hinging means at least partially across both plate members.

9. The repair device according to claim 1 wherein the body portion of the device further comprises an aperture located substantially near a hinging line in the centre of the device wherein the aperture is adapted to receive a holding means.

10. The repair device according to claim 1 wherein the locking means comprises a rigid body able to extend across a hinging line between two adjacent hinged plate members.

11. The repair device according to claim 1 wherein the locking means comprises a rigid annular ring which is able to be held by a holding means in the form of a threaded screw through the centre of the rigid annular ring and into the aperture located substantially near a hinging line in the centre of the device wherein the aperture is adapted to receive the holding means wherein the locking means is retained in front of the front faces of the plate members when biased to the substantially open flat position.

12. The repair device according to claim 11 wherein the locking means is adapted to provide a flush finish to receive the holding means in an after use position.

13. The repair device according to claim 1, wherein when the adhesive attaches the body portion to the wall, the locking means sits at least partially inside the hole.

14. The repair device of any one of claims 1 or 13, wherein the locking means comprises a base, the base comprising of an adhesive for attaching the locking means to the at least two plate members.

* * * * *